US005209602A

United States Patent [19]

Godbersen

[11] Patent Number: 5,209,602

[45] Date of Patent: May 11, 1993

[54] METHOD AND APPARATUS FOR INSERTING DOWEL BARS FOR A CONCRETE SLIP FORMING MACHINE

[75] Inventor: Gary L. Godbersen, Ida Grove, Iowa

[73] Assignee: Gomaco Corporation, Ida Grove, Iowa

[21] Appl. No.: 712,697

[22] Filed: Jun. 10, 1991

[51] Int. Cl.[5] ..... E01C 23/02; B28B 1/00

[52] U.S. Cl. ..... 404/88; 425/60

[58] Field of Search ..... 404/88; 425/60, 63; 366/108, 128

[56] References Cited

U.S. PATENT DOCUMENTS

| | | | |
|---|---|---|---|
| 2,295,947 | 9/1942 | Heltzel | 404/88 |
| 4,433,936 | 2/1984 | Moser | 404/88 |
| 4,688,963 | 8/1987 | Ritchey et al. | 404/88 X |
| 4,798,495 | 1/1989 | Laeuppi et al. . | |
| 4,799,820 | 1/1989 | Laeuppi et al. | 404/88 X |

FOREIGN PATENT DOCUMENTS

| | | | |
|---|---|---|---|
| 0196698 | 10/1986 | European Pat. Off. . | |
| 3811186 | 10/1989 | Fed. Rep. of Germany . | |
| 247993 | 7/1970 | U.S.S.R. | 404/88 |

OTHER PUBLICATIONS

Copy of two page brochure entitled Gomaco DBI 650 by Gomaco Corporation dated 1984.

Copy of eight page brochure entitled GP-2500 Full--Width Slipform Paver by Gomaco Corporation dated 1987.

*Primary Examiner*—Ramon S. Britts

*Assistant Examiner*—Nancy P. Connolly

*Attorney, Agent, or Firm*—Henderson & Sturm

[57] ABSTRACT

A method and apparatus for inserting dowel bars into a concrete slab is used in association with a slip forming machine of a type having a frame with a pan attached thereto for shaping uncured concrete into a continuous concrete slab. A plurality of openings are exposed through the pan and are spaced across the pan. Dowel bar retainers are disposed in each respective one of the openings for holding a dowel bar in readiness to be inserted into the concrete slab. A dowel bar inserter is disposed above each of the dowel bar retainers for pushing a dowel bar disposed in a respective one of the dowel bar retainers through a respective one of the openings and into the concrete slab. Apparatus is provided for automatically and independently actuating each one of the dowel bar inserters at a predetermined place in a concrete slab whereby respective ones of the dowel bars disposed in respective ones of the dowel bar inserters can be positioned in the concrete in a predetermined pattern across the concrete slab.

31 Claims, 4 Drawing Sheets

METHOD AND APPARATUS FOR INSERTING DOWEL BARS FOR A CONCRETE SLIP FORMING MACHINE

TECHNICAL FIELD

The present invention relates generally to a method and apparatus for inserting dowel bars for a concrete slip forming machine and more particularly to such a method and apparatus which inserts dowel bars directly through the pan which initially begins the concrete forming process of such a machine, instead of utilizing a separate dowel bar insertion device disposed behind the pan, which has been the custom of the prior art.

BACKGROUND ART

In concrete slip forming machines used for building roads and the like, it customary to form joints therein at predetermined intervals. One of the reasons for these joints is to hold adjacent sections of concrete together while at the same time allowing for them to shift to some extent, which occurs during freezing and thawing cycles. These dowel bars are typically inserted al the way across the pavement being formed and generally are aligned with the forward movement of the machine. These joints can be perpendicular to the slab and to the direction of forward movement of the machine or they can extend across the strip of concrete being formed at an angle thereto, which is commonplace in present day road construction so that each set of tires of a vehicle does not hit the joint at precisely the same time, thereby lessening the thumping problem that often occurs when the concrete joints are perpendicular to the direction of the movement of the vehicle traveling thereon.

The aforementioned concrete slip forming machines have for many years used dowel bar insertion mechanisms thereon, for example like those shown in U.S. Pat. Nos. 4,798,495 and 4,799,820, both the Laeuppi et al and both of which are incorporated herein by reference.

Conventional dowel bar inserting equipment is attached to the frame of a slip forming machine behind the pan, for example as shown in U.S. patent application Ser. No. 07/670,880 to Bengford et al, now U.S. Pat. No. 5,190,397, which patent is incorporated herein by reference. By utilizing this prior art technology with the dowel bar insertion mechanism being behind the pan, the concrete slab which has already been formed, shaped and smoothed by the pan is disturbed considerably by the insertion of the dowel bars therein, which creates a need for an additional trowel following the dowel bar insertion mechanism. Such a trowel is shown in U.S. patent application Ser. No. 07/549,829 to Godbersen et al, now U.S. Pat. No. 5061115. Also, a vibrating screed or correcting beam precedes the trowel on such a machine.

The need to have this dowel bar inserting apparatus and accompanying trowel mechanism makes it necessary to lengthen the machine by a considerable amount. This additional length creates many problems such as making the machine more difficult to move and requiring much more time to assemble and disassemble as these machines are moved from one job site to the other. Additionally, on roads that have sharp turns up or down, if the paver is too long, it can extend completely across such a low spot and not be capable of reaching low enough to correctly pave the surface thereunder. Furthermore, a machine which has a conventional dowel bar inserting thereon and a follow-up trowel mechanism almost always needs to be a four-track machine, which increase the costs of manufacture and use over that of a two-track minute, and also causes the aforementioned problem relating to the difficulty of being able to pave roads which have a large radius of curvature up and down.

Consequently, there is a need for a method and apparatus for inserting dowel bars on a concrete slip forming machine which will overcome the aforementioned disadvantages of the prior art.

DISCLOSURE OF THE INVENTION

The present invention relates generally to a method and apparatus for inserting dowel bars into a concrete slab in association with a slip forming machine of a type having a frame with a pan attached thereto for shaping uncured concrete into a continuous concrete slab. A plurality of openings are exposed through the pan and are spaced across the pan. Dowel bar retainers are disposed in each respective one of the openings for holding a dowel bar in readiness to be inserted into the concrete slab. A dowel bar inserter is disposed above each of the dowel bar retainers for pushing a dowel bar disposed in a respective one of the dowel bar retainers through a respective one the openings and into the concrete slab. Apparatus is provided for automatically and independently actuating each one of the dowel bar inserters at a predetermined place in a concrete slab whereby respective ones of the dowel bars disposed in respective ones of the dowel bar inserters can be positioned in the concrete in a predetermined pattern across the concrete slab.

An object of the present invention is to provide an improved method and apparatus for inserting dowel bars into a concrete slab in association with the use of a concrete slip forming machine.

Another object of the present invention is to provide a dowel bar inserting apparatus which does not disturb the concrete slab after it has been formed by the pan of a slip forming machine.

A still further object of the present invention is to provide a dowel bar inserting apparatus which eliminates the need for further troweling of the top of the concrete slab of a slip forming machine after dowel bars have been inserted.

A still further object of the present invention is to provide a dowel bar inserting apparatus which permits a slip forming machine to be much shorter and also permits such a machine to be a two-track machine instead of a more awkward and expensive four-track machine.

A further object of the present invention is to provide a computer-operated dowel bar inserting apparatus which permits each one of the dowel bars inserted independently and automatically.

One more object of the present invention is to provide a dowel bar inserting apparatus which can form a joint composed a parallel dowel bars wherein the joint is not perpendicular to the forward direction of travel of the machine and does this function without requiring that the dowel bar insertion device be disposed at an angle with respect to the forward direction of travel of a slip forming machine.

Other objects, advantages, and novel features of the present invention will become apparent from the following detailed description of the invention when considered in conjunction with the accompanying drawings.

BEST MODE FOR CARRYING OUT THE INVENTION

Figure 1:
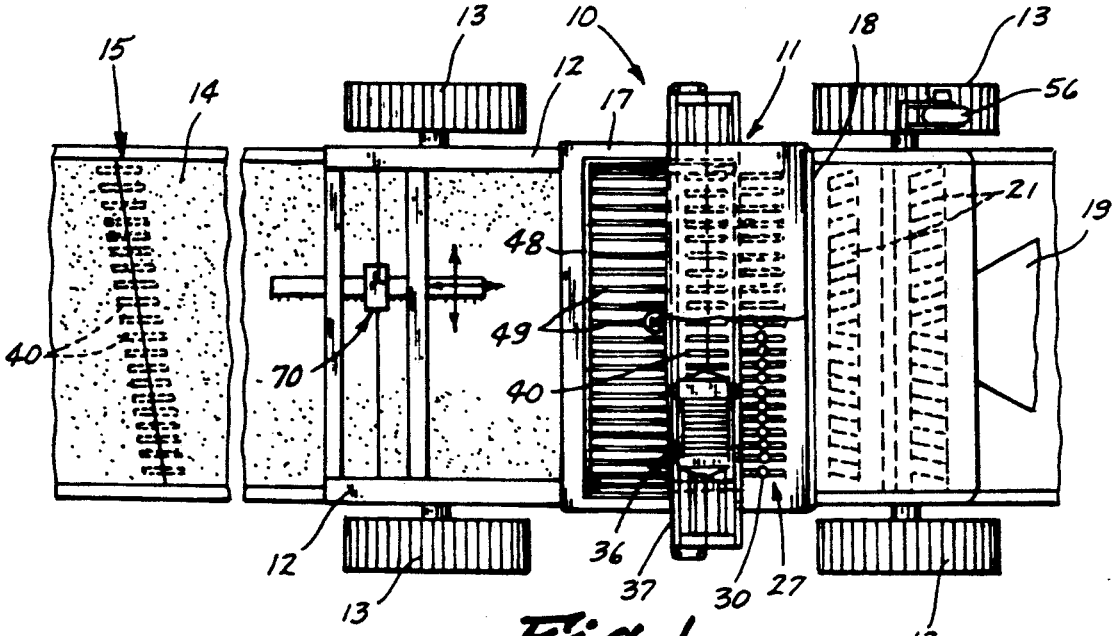
FIG. 1 is a top plan view of a preferred embodiment of the present invention shown in the process of forming a concrete slab having dowel bar joints disposed therein at an angle to the forward direction of travel of the machine.

Referring now to the drawings wherein like reference numerals designate identical or corresponding parts throughout the several views, FIG. 1 shows a slip forming machine (10) constructed in accordance with the present invention and having a dowel bar insertion mechanism (11) attached thereto.

The slip forming machine (10) includes a frame (12) having a plurality of tracks (13) attached generally to each corner thereof as is conventional and in this art and which is powered by a motor and transmission, neither of which is shown in the drawings. The slip forming machine (10) is utilized to form a concrete slab (14) having dowel bar joints (15) therein by dumping concrete (16) in front of a pan (17) having a front vertical wall (18). The concrete (16) is in a plastic and uncured condition as it is placed in front of the paver, shown in FIG. 1, over the augers (21) and vibrators (22), both of which are conventional in this art.

Figure 4:
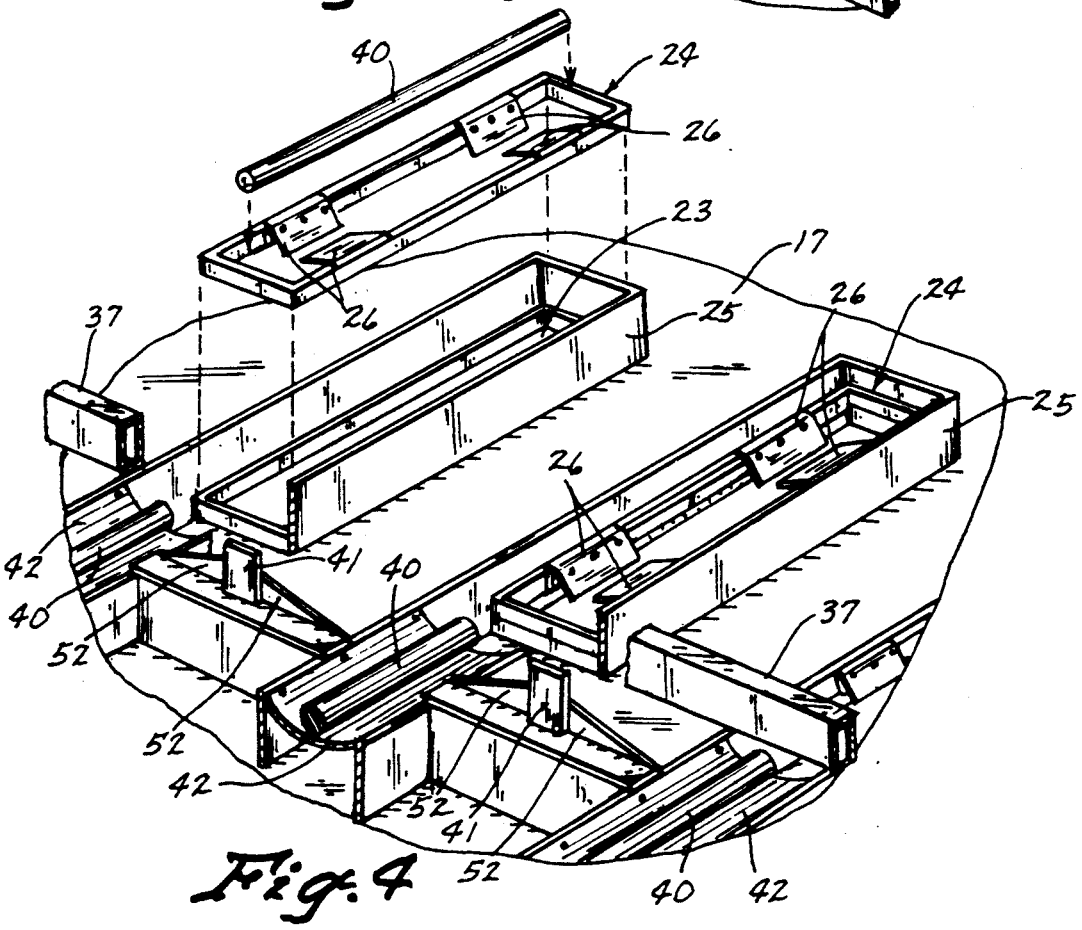
FIG. 4 is an enlarged partial exploded perspective view of dowel bar retainers attached through openings of the pan of the FIG. 1 machine along with the devices used to hold dowel bars in position prior to moving them into the dowel bar retainers.

FIG. 4 shows openings (23) formed in a row across the front portion of the pan (17) and having a plurality of dowel bar retainers (24) disposed therein and having spring steel members (26) for holding the dowel bar in place prior to insertion into the concrete slab (14).

Figure 5:
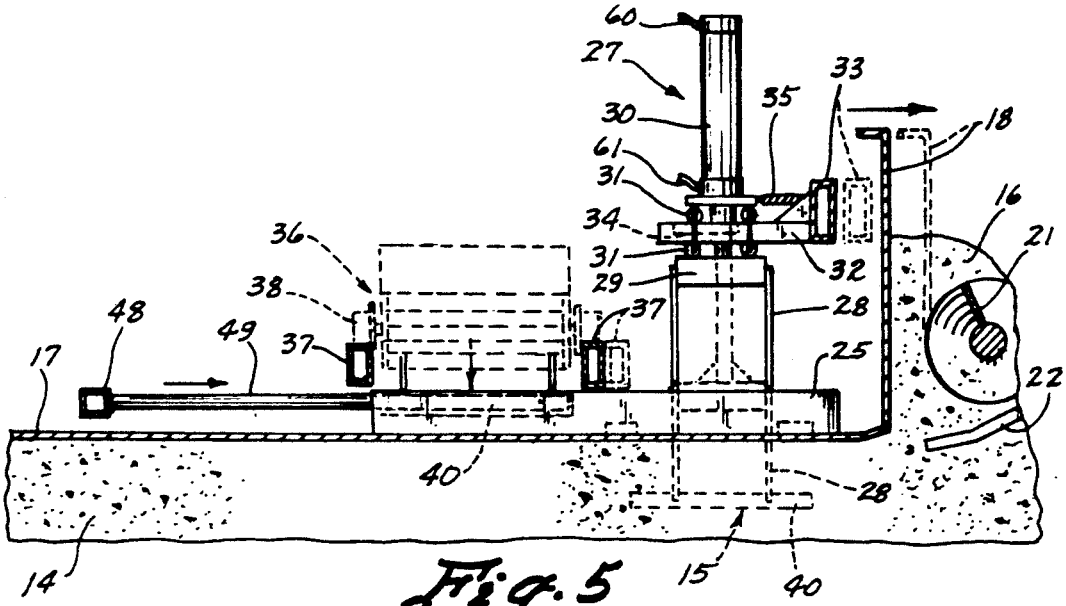
FIG. 5 is a side elevational view taken along line 5—5 of FIG. 2 and showing how the inserter forks of the present invention remain fixed with respect to the concrete slab while the machine moves forward from the position shown in solid lines of the pan to the position shown in dashed lines of the pan.

Dowel bar inserters (27) have forks (28) on the bottom thereof and a vibrator (29) for vibrating the forks (28) as they move up and down. Hydraulic cylinders (30) are utilized to actuate the forks (28) up and down and, referring to FIGS. 3 and 5, it is noted that these hydraulic cylinders (30) and vibrators (29) are mounted on a plurality of four roller mechanisms (31) that roll on cantilever member (32), which is welded to the top of the pan (18) or to the frame (12) such that the cantilever member (32) and member (33) move with the frame (12) and pan (17) and (18). A slot (34) is disposed in each of the cantilever members (32) as can best be seen in FIGS. 3 and 5 and the dowel bar inserters (27) are biased to the forward position in the slot as shown in FIG. 5, by tension spring (35).

Figure 3:
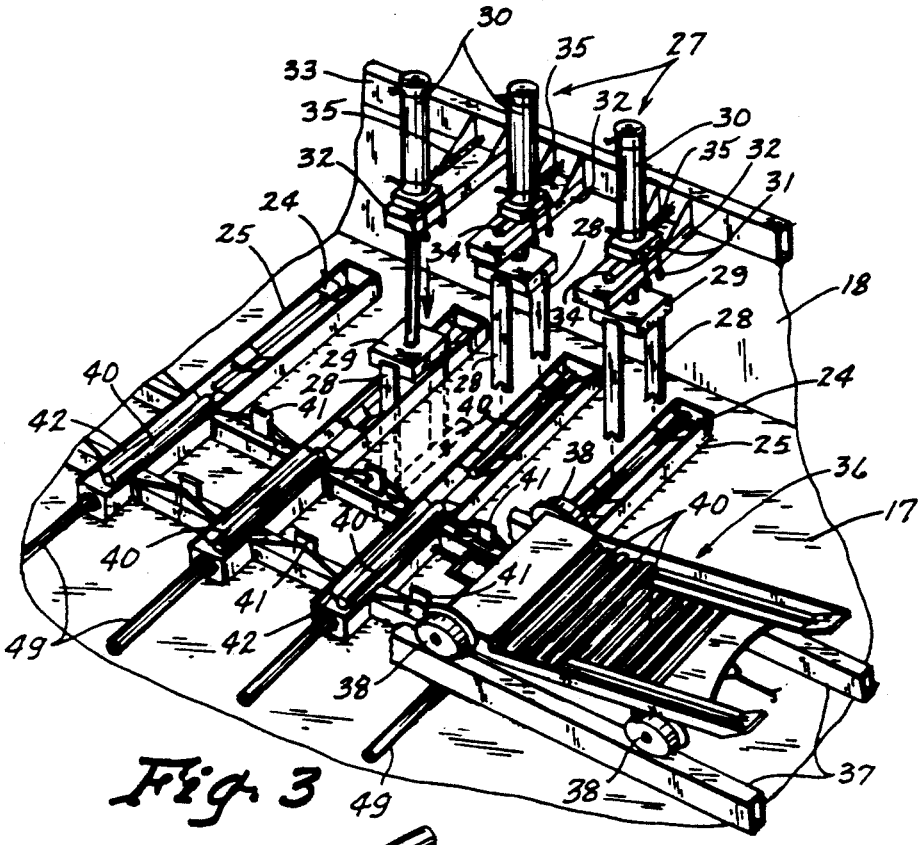
FIG. 3 is a partial perspective view of the pan of the machine of FIG. 1, showing how the dowel bars are inserted therethrough and how these dowel bars are moved into the proper positions to be so inserted.

Referring now to FIG. 3, it is noted that a trolley (36) is disposed for movement on rails (37) by trolley wheels (38). This trolley mechanism and its associated dowel bar unloaders are precisely of the type referred to above in the Bengford et al application, which is incorporated herein by reference. The only major differences between this trolley unloader (36) and that shown in the Bengford et al patent referred to above is that it is disposed perpendicular to the forward direction of movement of the machine and not at an angle with respect thereto.

Figure 6:
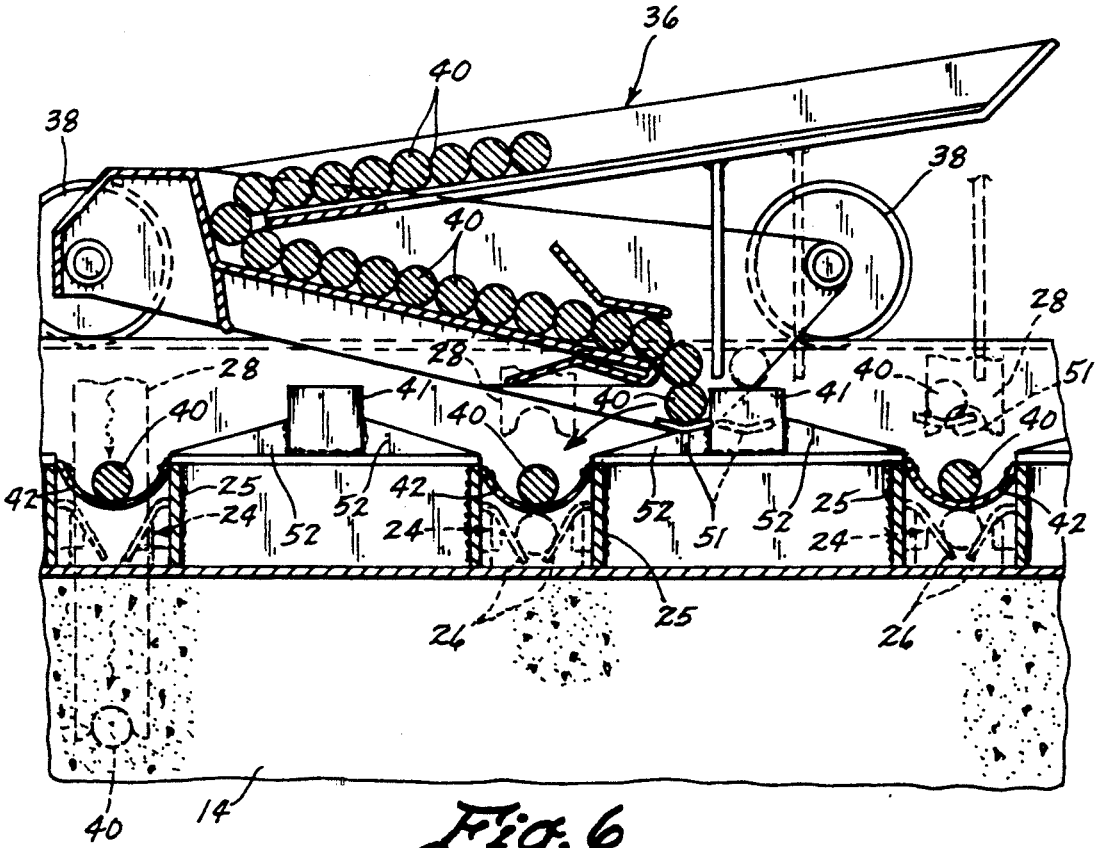
FIG. 6 is an enlarged cross-sectional view taken along line 6—6 of FIG. 2 and showing a trolley for distributing dowel bars into dowel bar holders prior to the time that the dowel bars are moved into dowel bar retainers shown in dashed lines and furthermore showing in dashed lines the dowel bar insertion forks which push the dowel bars from the dowel bar retainers into the concrete slab.

As the trolley (36) moves from one side of the machine to the other, dowel bars (40), for example as shown in FIG. 6, will hit stops (41) and therefore be pushed into dowel bar holders (42). This will happen regardless of which direction the trolley is moving across the machine. The trolley can then be loaded from either side of the machine whenever necessary.

Hydraulic cylinders (45) are attached at one end (46) to the pan (17) and at the other end thereof to a strut (48). A plurality of rams (49) are rigidly attached to the strut (48) and move therewith.

The operation of the apparatus (10) shown in FIG. 1 will now be explained. The trolley (36) is filled with dowel bars (40) and then the trolley (36) is moved from one side of the machine (10) to the other, for example, by cables which are not shown. As the trolley moves from one side to the other, the lowermost dowel bar (40) will be pushed off of the lower stops (51), as shown in FIG. 6, by stops (41). The dowel bars (40) will consequently roll down ramps (52) and into dowel bar holders (42).

Figure 2:
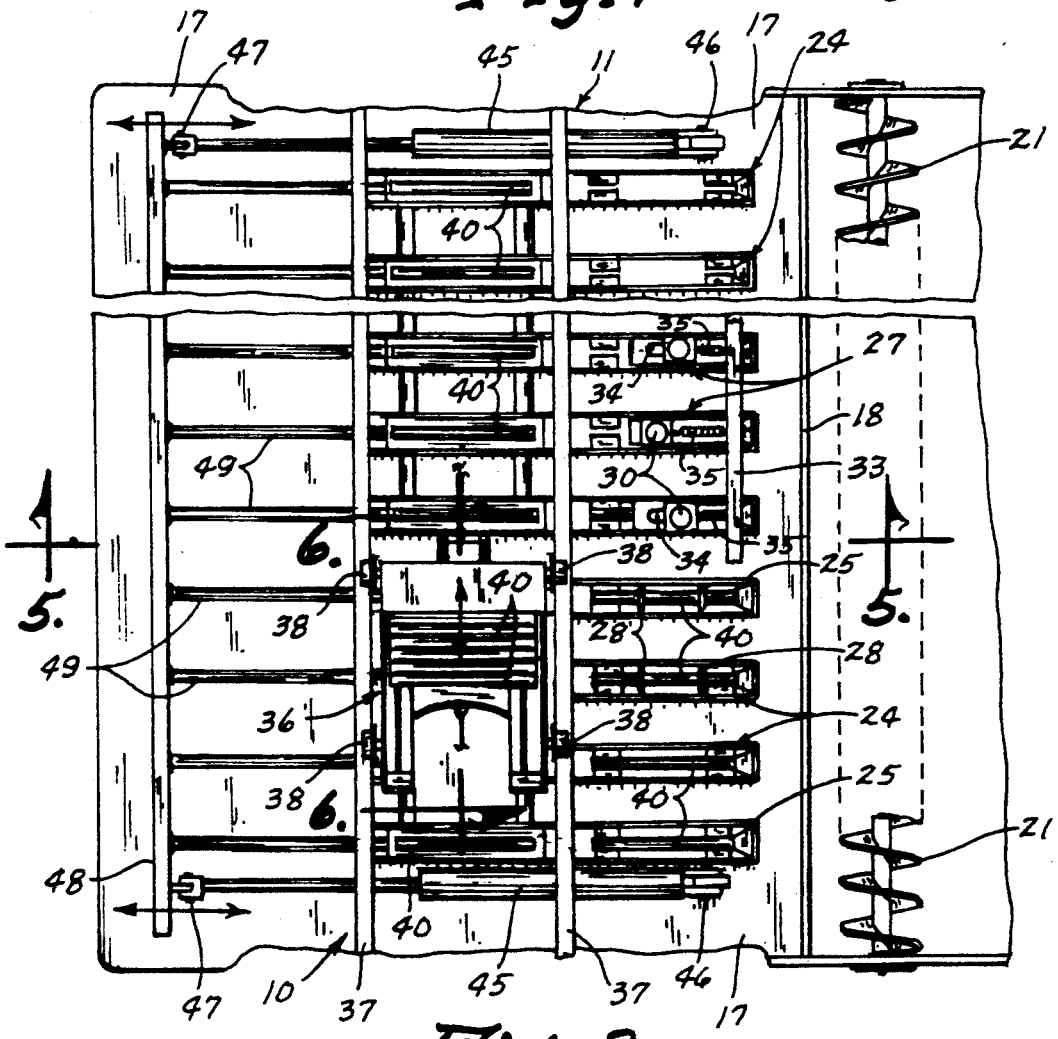
FIG. 2 is an enlarged plan view of portions of the apparatus shown in FIG. 1, including retainers for holding dowel bars, inserters for inserting dowel bars, and devices to load dowel bars into the dowel bar retainers.

After all of the dowel bar holders (42) have a dowel bar (40) therein, the hydraulic cylinders (45) are actuated from the position shown in FIG. 2 to a position to the right thereof to the extent that the rams (49) push the dowel bars (40) to the right and off of holders (42) and into respective ones of the dowel bar retainers (24) forwardly of the holders (42). One of the reasons for this arrangement is that the retainers (24) are normally directly below the engine compartment of the machine (10) and therefore there is a limited amount of space between the retainers (24) and the engine compartment (not shown). Therefore, some accommodation for space must be made and that is the reason why this system is utilized instead of the loading system shown in the Bengford et al patent application referred to above.

Figure 7:
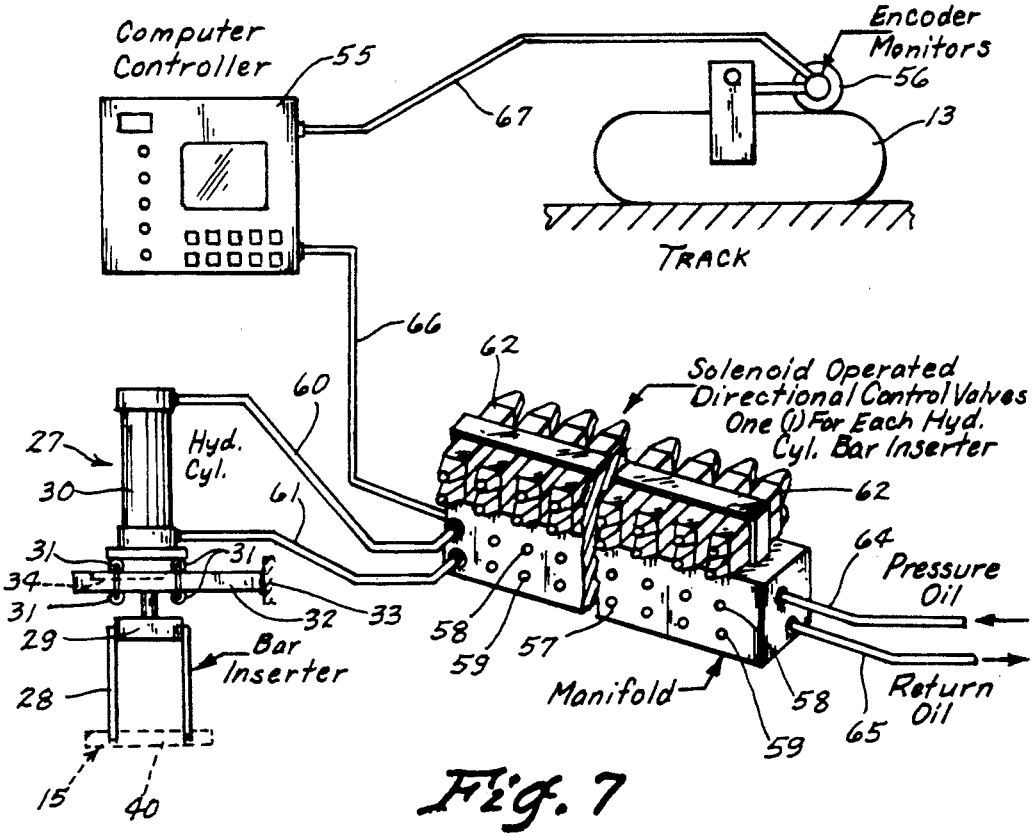
FIG. 7 is a schematic view of how a computer controls the dowel bar inserters in response to encoders on the machine track, whereby the dowel bar can be precisely placed in concrete slab because the computer will known precisely where the machine is and how far it has traveled due to the input from the encoder monitors.

Once all of the dowel bar retainers (24) have been loaded with dowel bars (40), the slip forming machine (10) is ready to be operated. The computer controller (55), shown in FIG. 7, is programmed to insert the dowel bars at predetermined intervals and in a predetermined arrangement, for example as shown in dashed lines in FIG. 1 at joint (15) having dowel bars (40) shown in dashed lines therebelow. If it is desired to have a joint which is perpendicular to the forward direction of travel of the machine (10), then the computer (55) would be programmed to fire all of the dowel bar inserters (27) at the same time at a predetermined location and the result would be just such a joint in the concrete, it being understood that the top of the slab (14) has a groove which is sawed into the top thereof after the concrete has dried, but this groove is directly over the top of the dowel bars (40) which have been inserted in the slab (14).

If, on the other hand, it is desired to have a joint (15) such as that shown in FIG. 1, then the dowel bars (40) would be inserted one at a time in sequence from the right side of the machine to the left side of the machine as the machine moves forwardly and to the right, as shown in FIG. 1. For example, at the beginning at the proper place on the slab (14), the encoder (56) will indicate to the computer that it is at the starting point and the computer would fire the right-most inserter (27), for example as shown in FIGS. 3 and 5 whereby the hydraulic cylinder pushes the forks (28) downwardly to push the dowel bar (40) into the slab (14).

Once the forks (28) enter the concrete slab (14) underneath the pan (17), the concrete will prevent the forks (28) from moving ahead with the machine and the forks (28) will slide in the groove (34) with the hydraulic cylinder (30) and move backwardly in the groove (34) as the machine (10) and pan (17) move forwardly. Once the cylinder (30) reaches the bottom of its stroke whereby the dowel bar (40) is inserted to the position shown in FIG. 5 (while at the same time the vibrator (29) operates to help part the concrete to get the dowel bar (40) to the place shown in FIG. 5) then the hydraulic cylinder (30) starts to move upwardly because of the valving changes caused by the computer (55). By the time the inserter (27) reaches the rear of the slot (34) as the machine is moving forwardly, the forks (28) will be up out of the concrete slab (14) and above the retainers (24). Once the forks (28) are above the retainers (24), the spring (35) will return the inserters back to the forward position with respect to the pan (17) and (18) for the next cycle.

After the dowel bars (40) have been inserted into the concrete slab (14), the pan (17) will smooth over the place where the forks (28) and dowel bars (40) have violated the concrete slab (14). Trowel (70) like that shown in the above mentioned Godbersen et al application, is optional.

Considering again that the joint is to be formed in the shape shown as joint (15) in FIG. 1, once the encoder (56) indicates that the machine has moved ahead by a predetermined number of counts, the next dowel bar inserter (27) to the left of the one that has just operated will begin and the dowel bar will be inserted just as before. This is not to say that one or more of the dowel bar inserters cannot be operating at the same time, for example a second dowel bar inserter may start to insert a dowel bar after the previous dowel bar inserter has begun its operation but before it has completed its operation. This sequence will continue until all the dowel bars (40) have been inserted across the slab (14) to form a joint like the joint (15).

It will also be appreciated that other types of joints could be formed, for example one of a V-shape or one of a curved shape if desired.

Referring again to FIG. 7, it is noted that the manifold (57) has a plurality of upper ports (58) and lower ports (59) which are connected to respective lines (60) and (61) of hydraulic cylinders (30). Solenoid valves (62), which can be like the solenoid valve (32) shown in U.S. patent application Ser. No. 07/509,187 to Bennett, now U.S. Pat. No. 5,101,360, which is incorporated herein by reference, can be operated so as to first have flow in one direction whereby oil pressure from line (64) passes out openings (58) and into upper lines (60) to extend the hydraulic cylinder (30) and cause the forks (28) to insert the dowel bar (40) to the position shown in FIG. 5. After that, the computer (55) will signal a reversal of the appropriate solenoid (62) whereby the flow will be switched so that the oil from the oil pressure line (64) flows out the lower ports (59) and into lower line (61), which will shorten the length of the hydraulic cylinder (30) and raise the forks (28) as discussed above.

Consequently, it will be readily appreciated to those skilled in this art that solenoid (62) can readily be operated by the computer (55) to connect lines (60) and (61) with pressure and return lines (64) and (65), respectively, and to quickly reverse the flow so that lines (61) and (60) connect respectively with lines (64) and (65). The Bennett patent application referred to above also explains how the encoders (56) work, if any additional explanation is necessary.

Accordingly, it will be appreciated that the preferred embodiment disclosed herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A dowel bar inserting apparatus for concrete slip forming machines comprising:

a frame having a longitudinal axis, said frame being adapted to be moved in a forward direction;

pan means attached to said frame for shaping uncured concrete into a continuous concrete slab;

a plurality of openings disposed through said pan means and spaced across said pan means;

a dowel bar retainer means disposed in each of said openings for holding a dowel bar in readiness to be inserted into the concrete slab;

inserter means disposed above each of said dowel bar retainer means, said inserter means being operatively attached to the frame for pushing a dowel bar disposed in one of said retainer means through a respective one of said openings and into the concrete slab; and means for independently actuating each one of said inserter means at a predetermined place in said concrete slab whereby respective ones of said dowel bars disposed in respective ones of said retainer means can be positioned in the concrete in a predetermined pattern across the concrete slab and wherein each of said inserter means can be actuated at times different than other of said inserter means.

2. The apparatus of claim 1 wherein said dowel bar inserting retainer means holds said dowel bars parallel to said longitudinal axis.

3. The apparatus of claim 1 wherein said pan means includes a portion thereof behind said openings for smoothing the concrete above dowel bars after they are inserted into the concrete slab.

4. The apparatus of claim 1 including means for receiving uncured concrete immediately in front of said pan means.

5. The apparatus of claim 4 including auger means for moving excess uncured concrete in front of said pan means.

6. The apparatus of claim 1 including means for filling said inserter means with dowel bars.

7. The apparatus of claim 6 wherein said filling means comprises a respective dowel bar holding means for holding one of said dowel bars rearwardly of each of said retainer means.

8. The apparatus of claim 7 including means for moving said dowel bars from said respective holding means to said respective retainer means.

9. The apparatus of claim 8 including means for loading each of said holding means.

10. The apparatus of claim 9 including a trolley means for selectively passing over said holding means from one side of the frame to the other side.

11. The apparatus of claim 10 including means for dropping a dowel bar into each one of said holding means as said trolley means passes over each respective one of said holder means.

12. The apparatus of claim 8 wherein said moving means includes hydraulic ram means for pushing said dowel bars from said holding means to said retainer means.

13. The apparatus of claim 1 wherein said inserter means includes fork means for pushing said dowel bars downwardly from said retainer means into said concrete slab.

14. The apparatus of claim 1 including lost motion means for permitting said fork means to remain substantially at said predetermined position in the concrete slab as it moves down into the concrete and up out of the concrete as the frame continues to move forward with respect to the concrete slab.

15. The apparatus of claim 14 including biasing means connected to said fork means for biasing said fork means to a forwardmost position with respect to said frame prior to insertion of said fork means into such concrete slab and permitting said fork means to move to rearwardmost position with respect to said frame at a time just prior to the time that said fork means is retracted from said concrete slab.

16. The apparatus of claim 1 wherein said fork means includes vibrator means for vibrating said fork means as said fork means pushes said dowel bar into said concrete slab.

17. A method of inserting dowel bars while using concrete slip forming machines of a type including a frame having a longitudinal axis, said frame being adapted to be moved in a forward direction; pan means attached to said frame for shaping uncured concrete slab, said pan means having a front end and a rear end; a plurality of openings disposed through said pan means and spaced across said pan means; dowel bar retainer means disposed in each of said openings for holding a dowel bar in readiness to be inserted into the concrete slab; inserter means disposed above each of said dowel bar retainer means operatively attached to the frame for pushing a dowel bar disposed in one of said dowel bar inserting retainer means through a respective one of said openings and into the concrete slab; and means for independently actuating each one of said inserter means at a predetermined place in said concrete slab whereby respective ones of said dowel bars disposed in respective ones of said dowel bar inserting retainer means can be positioned in the concrete in a predetermined pattern across the concrete slab, said method comprising:

independently actuating each respective one of said inserter means when said dowel bar retainer means is disposed directly above said predetermined place in said concrete slab where a dowel bar disposed therein is desired to be placed in said concrete slab whereby each of said inserter means can be actuated at times different than other of said inserted means so that any desired placement of dowel bars can be achieved.

18. The method of claim 17 including the steps of actuating at least one of said inserter means at a time different than when another one of said inserter means is actuated.

19. The method of claim 18 including the step of moving at least one of said dowel bars through an opening in said pan means.

20. A method of inserting dowel bars while using concrete slip forming machines of a type including a frame having a longitudinal axis, said frame being adapted to be moved in a forward direction; a pan means attached to said frame for shaping uncured concrete into a continuous concrete slab, said pan means having a front end and a rear end; vibrator means disposed on the front of said frame for extending into and vibrating uncured concrete placed at the front of said frame; a plurality of dowel bar retainer means operatively attached to said frame between said vibrator means and the rear of said pan means for holding a dowel bar in readiness to be inserted into the concrete slab; inserter means disposed above each of said dowel bar retainer means operatively attached to the frame for pushing a dowel bar disposed in one of said dowel bar inserting retainer means into the concrete slab; and means for independently actuating each one of said inserter means at a predetermined place in said concrete slab whereby respective ones of said dowel bar disposed in respective ones of said dowel bar inserting retainer means can be positioned in the concrete in a predetermined pattern across the concrete slab, said method comprising:

independently actuating each respective one of said inserter means when said dowel bar retainer means is disposed directly above said predetermined place in said concrete slab where a dowel bar disposed therein is desired to be placed in said concrete slab whereby each of said inserter means can be actuated at times different than other of said inserter means so that any desired placement of dowel bars can be achieved.

21. A concrete slip forming machine of a type including a frame having a longitudinal axis, said frame being adapted to be moved in a forward direction;

pan means attached to said frame for shaping uncured concrete into a continuous concrete slab, said pan means having front end and a rear end;

vibrator means operatively disposed on the front of said frame for extending into a vibrating uncured concrete placed at the front of said frame prior to the time said uncured concrete enters the front end of said pan means;

a plurality of dowel bar retainer means operatively attached to said frame between said vibrator means and the rear of said pan means for holding a dowel bar in readiness to be inserted into the concrete slab;

means for independently actuating each respective one of said inserter means at the same or different respective time at a respective predetermined place in said concrete slab whereby respective ones of said dowel bars disposed in respective ones of said dowel bar inserting retainer means can be positioned in the concrete in a predetermined pattern across the concrete slab and whereby each of said inserter means can be actuated at times different than other of said inserter means.

22. The apparatus of claim 21 including a plurality of openings disposed through said pan means and spaced across said pan means and wherein said dowel bar retainer means are disposed in each of said openings.

23. The apparatus of claim 1 wherein said actuating means includes means for sequentially actuating each respective one of said inserter means, one after another, from one side of said frame to the other side as said frame moves forward.

24. The apparatus of claim 1 wherein said actuating means includes computer means for automatically actuating each one of said inserter means at a desired place in said concrete slab.

25. A dowel bar inserting apparatus for concrete slip forming machines comprising:

a frame having a longitudinal axis, said frame being adapted to be moved in a forward direction, said frame having a front portion, a rear portion and an intermediate portion;

pan means attached to the front portion of said frame for shaping uncured concrete into a continuous concrete slab, said pan means having a front end and a rear end;

vibrator means operably attached to the front portion of said frame for extending into and vibrating uncured concrete placed at the front of said frame prior to the time said uncured concrete enters the front end of said pan means;

a dowel bar retainer means operatively attached to said frame between said vibrator means and the rear of said pan means for holding a dowel bar in readiness to be inserted into the concrete slab;

inserter means disposed above said dowel bar retainer means, said inserter means being operatively attached to the frame for pushing dowel bars disposed in said retainer means into the concrete slab; and means for actuating said inserter means at a predetermined place in said concrete slab whereby said dowel bars disposed in said retainer means can be positioned in the concrete in a predetermined pattern across the concrete slab.

26. The apparatus of claim 25 wherein said actuating means includes means for independently actuating each inserter means.

27. The apparatus of claim 1 wherein there are at least ten openings, dowel bar retainer means and actuating means.

28. The method of claim 17 wherein the step of independently actuating includes actuating at least ten actuating means.

29. The method of claim 20 wherein the step of independently actuating includes actuating at least ten actuating means.

30. The apparatus of claim 21 wherein there are at least ten dowel bar retainer means.

31. The apparatus of claim 25 wherein there are at least ten dowel bar retainer means.

* * * * *